United States Patent [19]

Marino

[11] 3,946,275

[45] Mar. 23, 1976

[54] BINARY SWITCHING VIDEO AMPLIFIER

[75] Inventor: Francis C. Marino, Dix Hills, N.Y.

[73] Assignee: Redactron Corporation, Hauppauge, N.Y.

[22] Filed: Oct. 7, 1974

[21] Appl. No.: 512,533

[52] U.S. Cl. ..... 315/383; 315/379; 315/381; 315/384; 178/7.3 DC; 178/7.5 DC; 178/DIG. 26

[51] Int. Cl.[2] ..... H01J 29/52

[58] Field of Search..... 315/30, 365, 379–381, 315/383, 384, 397; 178/7.3 DC, 7.5 DC, DIG. 26

[56] References Cited

UNITED STATES PATENTS

| | | | |
|---|---|---|---|
| 3,159,751 | 12/1964 | Bogdan, Jr. et al. | 178/7.3 DC |
| 3,336,498 | 4/1967 | Castanera | 315/365 |
| 3,396,236 | 8/1968 | Foster | 178/DIG. 26 |
| 3,544,714 | 12/1970 | Stoll | 178/7.3 DC |
| 3,863,096 | 1/1975 | Sennik | 315/380 |

*Primary Examiner*—Maynard R. Wilbur
*Assistant Examiner*—T. M. Blum
*Attorney, Agent, or Firm*—Hane, Baxley & Spiecens

[57] ABSTRACT

A video amplifier for driving an electron beam intensity controlling electrode of a cathode ray tube comprises at least one solid state high speed binary switch which is connected via a coupling capacitor to the controlling electrode while a D.C. restoration means eliminates the chance of any droop in D.C. level of the signal fed to the controlling electrode.

12 Claims, 1 Drawing Figure

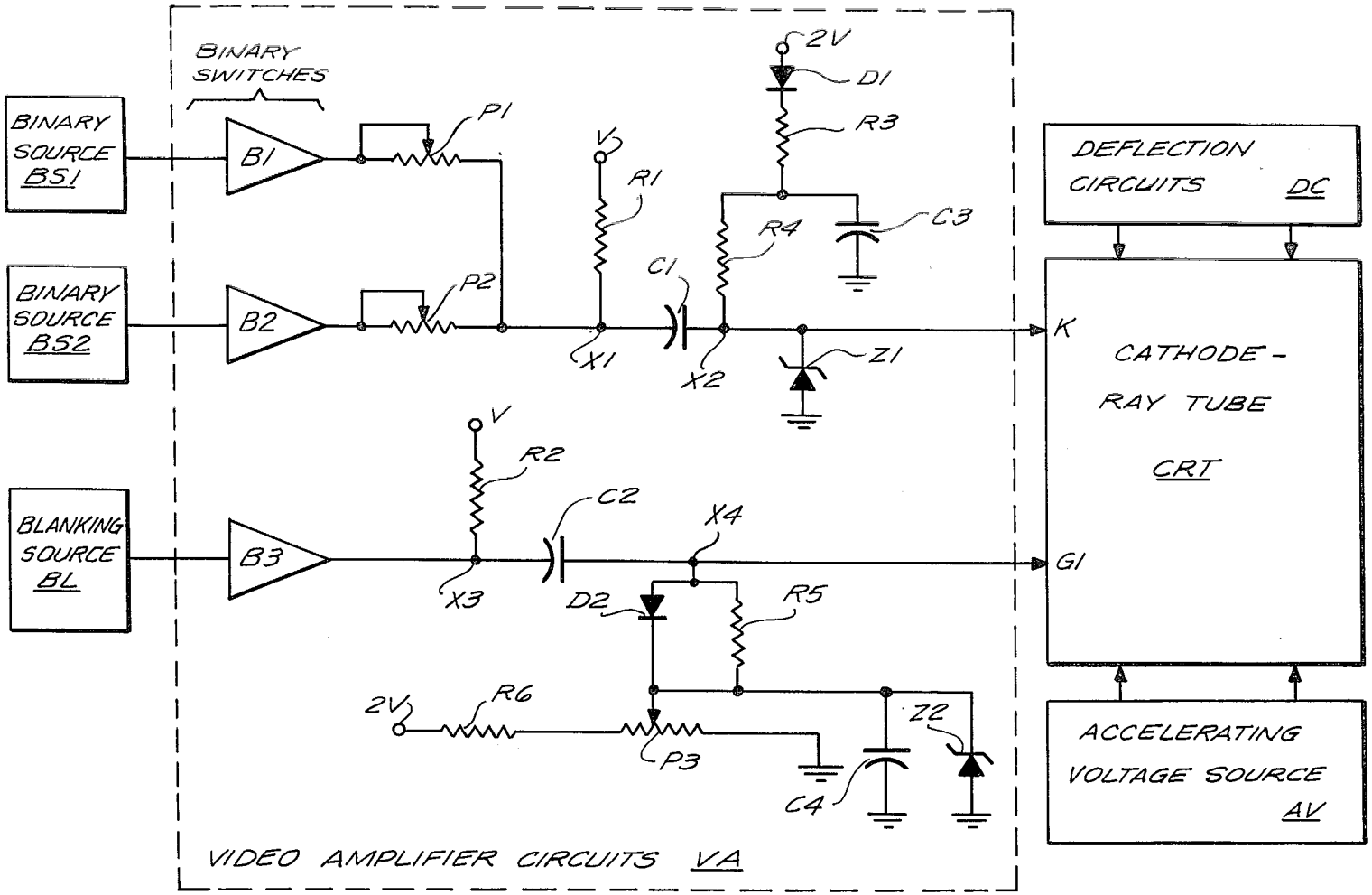
DEFLECTION CIRCUITS DC
CATHODE-RAY TUBE CRT
ACCELERATING VOLTAGE SOURCE AV
K
G1
VIDEO AMPLIFIER CIRCUITS VA
BINARY SWITCHES
B1
B2
B3
BINARY SOURCE BS1
BINARY SOURCE BS2
BLANKING SOURCE BL
2V
D1
R3
C3
R4
Z1
X2
C1
V3
R1
X1
P1
P2
V
R2
X3
C2
X4
R5
D2
P3
Z2
C4
R6
2V

BINARY SWITCHING VIDEO AMPLIFIER

This invention pertains to video amplifiers for driving the video or electron beam intensity control electrodes, such as the cathode and control guides of a CRT (cathode ray tube).

Video amplifiers commonly employed in presently available CRT monitors are of the Class A type and are most always D.C. coupled to the cathode of the CRT. In the field of high resolution monitors, where video signal frequencies up to 20 mhz are encountered, these amplifiers are composed of relatively expensive transitors, or employ vacuum tubes due to the relatively high operative voltages of the CRT, the use of D.C. coupling, and the need for video signal amplitudes in excess of 15 volts in order to produce an acceptably bright image on the CRT screen.

In most CRT terminal applications where characters are displayed, the video information is digital or binary in nature, rather than analog, owing to the fact that digitally-formed characters are displayed on the CRT screen. The need for a Class A amplifier is basically not required in digital applications since an infinite range of intensity levels (gray-scale variation) is not required when displaying characters, as opposed to television-type scenes.

In many applications, it is often required by the digital user that a CRT monitor display a field of characters at two different intensity levels. This is commonly referred to as the "intensify" mode of operation where certain characters, words, fields or lines or information are intensified relative to the basic intensity level of the main display. In addition, some users require the "blanking" intervals to be operated in the so-called "black" region so that background illumination may be obtained (with raster-scan monitors) without displaying the vertical and horizontal "retrace" lines.

Since most monitors utilize a single Class A amplifier of the type described, it is left to the digital user to combine the digital video and blanking signals into, what is commonly referred to as a "composite" video signal. A small-amplitude composite signal is fabricated from the digital signals in the user's system logic and transferred to the monitors' Class A amplifier over a conventional cable which is suitable for the frequencies encountered. This composite signal is amplified, the same as an analog signal defining a television-type scene would be, and directly coupled to the cathode of the CRT. Background (brightness) illumination is provided by varying the relative potential between cathode and control grid (G1).

The use of a Class A amplifier in a monitor which displays digitally formed characters has many disadvantages. In particular, the digital user must form a composite signal using some sort of analog technique. A digital user prefers to provide only digital signals in order to reduce cost and complexity in hardware that is digitally-oriented. This is especially true when high video frequencies are involved since high frequency digital devices are generally more economical and packaged more conveniently than high frequency analog devices. In addition, the monitor's Class A amplifier gets to be relatively more expensive at the higher video frequencies and, for this reason, is available only in the more expensive monitors.

It is accordingly an object of the invention to provide an improved video amplifier for use in CRT displays.

It is another object of the invention to provide an improved amplifier for driving the intensity controlling electrodes of a CRT which displays digitally formed characters.

Briefly, the invention contemplates a solid state binary switch which is capacitor coupled to an intensity controlling electrode of a CRT.

According to a feature of the invention D.C. restoration is provided at the electrode to ensure negligible variation in the display intensity.

Another feature of the invention contemplates providing very simple means for combining several video channels to drive one electrode of the CRT while providing each channel with its own intensity control.

A further feature of the invention insures longer CRT life by providing simple means to prevent any electron beam-burning of spots in the screen of the tube when power is removed from the system.

Other objects, the features and advantages of the invention will be apparent from the following detailed description when read with the accompanying drawing whose sole FIGURE shows a presently preferred embodiment of the invention.

In the sole FIGURE a cathode ray tube CRT receives deflection signals from deflections circuits DC, accelerating or operating potentials from accelerating voltage source AV and video or electron beam intensity controlling signals from video amplifier VA.

In the usual manner the deflection circuits DC generate deflection currents which pass through the deflection yoke of the tube to position the electron beam where desired. In addition, source AV provides voltages to heat the cathode of the tube CRT and the voltages to impel the electrons toward the screen. Since these circuits form no part of the invention they will not be discussed.

In the tube CRT, with all other things being equal, the intensity of the electron beam is controlled by the amplitude of the potential different between the cathode K and the control grid G1. The video amplifier circuits VA perform this function.

In particular, the cathode K receives binary signals from binary source BS 1 and binary source BS 2 via binary switches B 1 and B 2 respectively. Each of the switches can be an open-collector type 7407 amplifier. In effect, a binary or pulse signal at the input of the amplifier switches the amplifier from the cut-off to full on state. The open collector of switch B 1 is connected via potentiometer P 1 to point X 1 while the open collector of switch B 2 is connected via the potentiometer P 2 to point X 1. Point X 1 is connected via resistor R 1 to source of operating voltage V. Thus, resistor R 1 and potentiometers P 1 and P 2 not only provide the output circuits for the collectors of the switches B 1 and B 2 but also operate as an adding or combining circuit to form a composite signal from two sources. Note also that potentiometers P 1 and P 2 permit selectively controlling the amplitude of each component of the composite signal to provide the selective intensity control desired in the intensity mode of operation.

Point X 1 is connected via coupling capacitor C 1 to cathode K. The coupling capacitor C 1 provides D.C. isolation between the circuitry associated with cathode K which requires higher D.C. voltage levels and the circuitry of binary switches B 1 and B 2 which cannot tolerate such higher voltage levels. In order to prevent shifting of the D.C. level which normally occurs when using capacitor coupling a Zener diode Z 1 is connected between points X 2 and ground. In order to provide the proper operating cathode voltage the point X 2 is connected to a voltage source 2V via resistors R 3 and R 4 and diode D 1. Note, to accomplish this only resistor R 4 is required. As will hereinafter become apparent, diode D 1 and resistor R 3 perform another function. Note, that not only does Zener diode Z 1 provide D.C. restoration, but it also prevents any high-voltage surges occuring at the cathode K, when the cathode ray tube CRT is turned on or off, from being fed back via the coupling capacitor C 1 to the binary switches B 1 and B 2.

Blanking signals from blanking sources BL are fed to binary switch B 3 (similar to binary switches B 1 and B 2). The open collector output of switch B3 is connected to point X 3, which is connected via load resistor R 2 to operating voltage source V. Point X 3 is connected via coupling capacitor C 2 to point X 4 and control grid G 1. Coupling capacitor C 2 provides the D.C. isolation between the output of binary switch B 3 and the cathode K of the cathode ray tube CRT. D.C. restoration is provided by diode D 2 and resistor R 5 connected in parallel between point X 4 and the wiper of potentiometer P 3 whose resistor is connected between operating voltage source 2V and ground. Note that since a quiescent D.C. voltage level of cathode K is fixed by the breakdown voltage of Zener diode Z1, the brightness control of the CRT is provided by varying the quiescent D.C. voltage level of the grid G 1. This is accomplished by potentiometer P 3. Zener diode Z 2 connected as shown provides protection against high-voltage surges appearing on the grid G 1.

As an example, in operation, voltage source 2V is +48 volts, voltage source V is at +24 volts and the breakdown voltage of the Zener diodes is slightly less that +48 volts. Thus, the video signals at point X 1 can have a maximum amplitude of 24 volts while the D.C. voltage level of cathode K sits quiescently at about +48 volts. Consequently, at point X 2 and cathode K the video signals swing from a reference level of about +48 volts down to no lower than +24 volts. The blanking signals also swing 24 volts at point X 3. Potentiometer P 3 is arranged with an auxiliar resistor R 6 so that the quiescent voltage at G 1 can be varied between ground and +32 volts. Therefore, the resulting relative D.C. bias potential of the control grid G 1 relative to the cathode K is from −48 volts to −16 volts. The −16 volts relative bias represents a bright background while the −48 volt relative bias effectively cuts off the CRT resulting in no visible raster. Note that the blanking signal will drive the control grid G 1 more negative than the established relative bias by 24 volts. Therefore, the CRT is cut off and shows no visible raster during the blanking signal independent of the background or brightness level established by potentiometer P 3.

Finally, in order to prevent a burning of a hole in the phosphor of the cathode ray tube CRT when power is turned off because of the time required for the cathode K to cool and the circuits providing the accelerating voltages to discharge, capacitor C 3 is provided. The capacitor C 3 is charged to a cut off voltage via initial charging surge limiting resistor R 3 and diode D 1 connected to source 2V. The capacitance of capacitor C 3 is chosen so that the time required for its discharge is longer than the time required for the capacitors in the accelerating voltage circuits to discharge.

What is claimed is:

1. A video amplifier for driving an electron beam intensity controlling electrode of a cathode ray tube which operates at a first set of voltage levels comprising a first solid state high speed binary switch means operating at a second set of voltage levels smaller than said first set for switching between first and second conductive states, said binary switch means having an input terminal for receiving a binary signal and an output terminal for transmitting a binary signal, a first coupling capacitor having a first terminal connected to said output terminal and a second terminal connected to the electrode of the cathode ray tube and a D.C. restoration means connected to the second terminal of said first coupling capacitor.

2. The video amplifier of claim 1 wherein said D.C. restoration means comprises a first source of a reference potential and a Zener diode connected between said first source and the second terminal of said first coupling capacitor, a second source of an operating potential, and means for connecting said second source to said Zener diode so that said Zener diode is in the reverse current breakdown state.

3. The video amplifier of claim 1 further comprising a second solid state high speed binary switch means operating at the second set of voltage levels for switching between first and second conductive states, said second binary switch means having an input terminal for receiving another binary signal and an output terminal for transmitting the other binary signal amplified, a first selectively operable signal attenuator means connecting the output terminal of said first binary switch means to said first terminal of said coupling capacitor and a second selectively operable signal attenuator means connecting the output terminal of said second binary switch means to said first terminal of said first coupling capacitor.

4. The video amplifier of claim 3 further comprising D.C. restoration means connected to the second terminal of said first coupling capacitor.

5. A video amplifier for driving an electron beam controlling electrode of a cathode ray tube which operates at a first set of voltage levels comprising a first solid state high speed binary switch means operating at a second set of voltage levels smaller than said first set for switching between first and second conductive states, said binary switch means having an input terminal for receiving a binary signal and an output terminal for transmitting a binary signal, a second solid state high speed binary switch means operating at the second set of voltage levels for switching between first and second conductive states, said second binary switch means having an input terminal for receiving another binary signal and an output terminal for transmitting the other binary signal amplified, a first coupling capacitor having a first terminal and a second terminal connected to the electrode of the cathode ray tube, a first selectively operable signal attenuator means connecting the output terminal of said first binary switch means to said first terminal of said coupling capacitor and a second selectively operable signal attenuator means connecting the output terminal of said second binary switch means to said first terminal of said first coupling capacitor.

6. A video amplifier for driving a cathode ray tube having cathode and control grid electrodes operating at a first set of voltage levels, said amplifier comprising a first solid state high speed binary switch means operating at a second set of voltage levels smaller than said first set for switching between first and second conductive states, said binary switch means having an input terminal for receiving a binary signal and an output terminal for transmitting a binary signal, a first coupling capacitor having a first terminal connected to said output terminal and a second terminal connected to one of said electrodes, a second solid state high speed binary switch means operating at the second set of voltage levels, said second binary switch means having an input terminal for receiving another binary signal and an output terminal for transmitting the other binary signal amplified, and a second coupling capacitor having a first terminal connected to the output terminal of said second binary switch means and a second terminal connected to the other of said electrodes.

7. The video amplifier of claim 6 further comprising a storage capacitor means connected to one of said electrodes, a source of biasing potential, an unidirectional current conducting means connecting said source of biasing potential to said storage capacitor means so that a bias potential is developed across said storage capacitor means of such a magnitude to be able to temporarily cut off the electron beam in the cathode ray tube in the absence of any other potentials or signals applied to said electrodes.

8. The video amplifier of claim 6 further comprising a first D.C. restoration means connected to the second terminal of said first coupling capacitor and a second D.C. restoration means connected to the second terminal of said second coupling capacitor.

9. The video amplifier of claim 6 further comprising a third solid state high speed binary switch means operating at the second set of voltage levels for switching between first and second conductive states, said third binary switch means having an input terminal for receiving a third binary signal and an output terminal for transmitting the third binary signal amplified, a first selectively operable signal attenuator means connecting the output terminal of said first binary switch means to said first terminal of said coupling capacitor and a second selectively operable signal attenuator means connecting the output terminal of said third binary switch means to said first terminal of said first coupling capacitor.

10. The video amplifier of claim 9 further comprising a first D.C. restoration means connected to the second terminal of said first coupling capacitor and a second D.C. restoration means connected to the second terminal of said second coupling capacitor.

11. The video amplifier of claim 10 wherein one of said D.C. restoration means comprises a first source of a reference potential and a Zener diode connected between said first source and the second terminal of said first source and the second terminal of said first coupling capacitor, a second source of an operating potential, and means for connecting said second source to said Zener diode so that said Zener diode is in the reverse current breakdown state and the other of said D.C. restoration means comprises a source of a controllably variable bias voltage, the combination of a unilateral conducting device and a resistor connected in parallel and means for connecting said combination between said source of a controllably variable bias voltage and the second terminal of said second coupling capacitor.

12. The video amplifier of claim 11 further comprising a storage capacitor means connected to one of said electrodes, a source of biasing potential, a unidirectional current conducting means connecting said source of biasing potential to said storage capacitor means so that a bias potential is developed across said storage capacitor means of such a magnitude to be able to temporarily cut off the electron beam in the cathode ray tube in the absence of any other potentials or signals applied to said electrodes.

* * * * *